United States Patent [19]

Timm

[11] 4,027,589

[45] June 7, 1977

[54] PORTABLE IMPRINTER

[75] Inventor: David G. Timm, St. Paul, Minn.

[73] Assignee: Timmco, Incorporated, St. Paul, Minn.

[22] Filed: May 12, 1975

[21] Appl. No.: 576,476

[52] U.S. Cl. ..... 101/269

[51] Int. Cl.[2] ..... B41F 3/04

[58] Field of Search ..... 101/269–274, 101/45, 56

[56] References Cited

UNITED STATES PATENTS

| | | | |
|---|---|---|---|
| 3,059,570 | 10/1962 | Wagner | 101/269 X |
| 3,232,228 | 2/1966 | Bell et al. | 101/269 |
| 3,508,488 | 4/1970 | Maul et al. | 101/269 X |
| 3,565,007 | 2/1971 | Tyburski | 101/269 |
| 3,705,548 | 12/1972 | Waterman | 101/269 |
| 3,735,701 | 5/1973 | Ackerman | 101/269 |
| 3,739,718 | 6/1973 | Zupancic | 101/45 |

*Primary Examiner*—Edward M. Coven
*Attorney, Agent, or Firm*—Merchant, Gould, Smith, Edell, Welter & Schmidt

[57] ABSTRACT

A portable imprinter for transferring data, in the form of raised characters on a credit card or the like, to a receiving paper by pressure. A pressure element is mounted directly in an actuator which slides in grooves formed in the wall of a frame member, and travels across an opening into which it protrudes slightly to press the receiving paper with its transfer element against the card.

2 Claims, 5 Drawing Figures

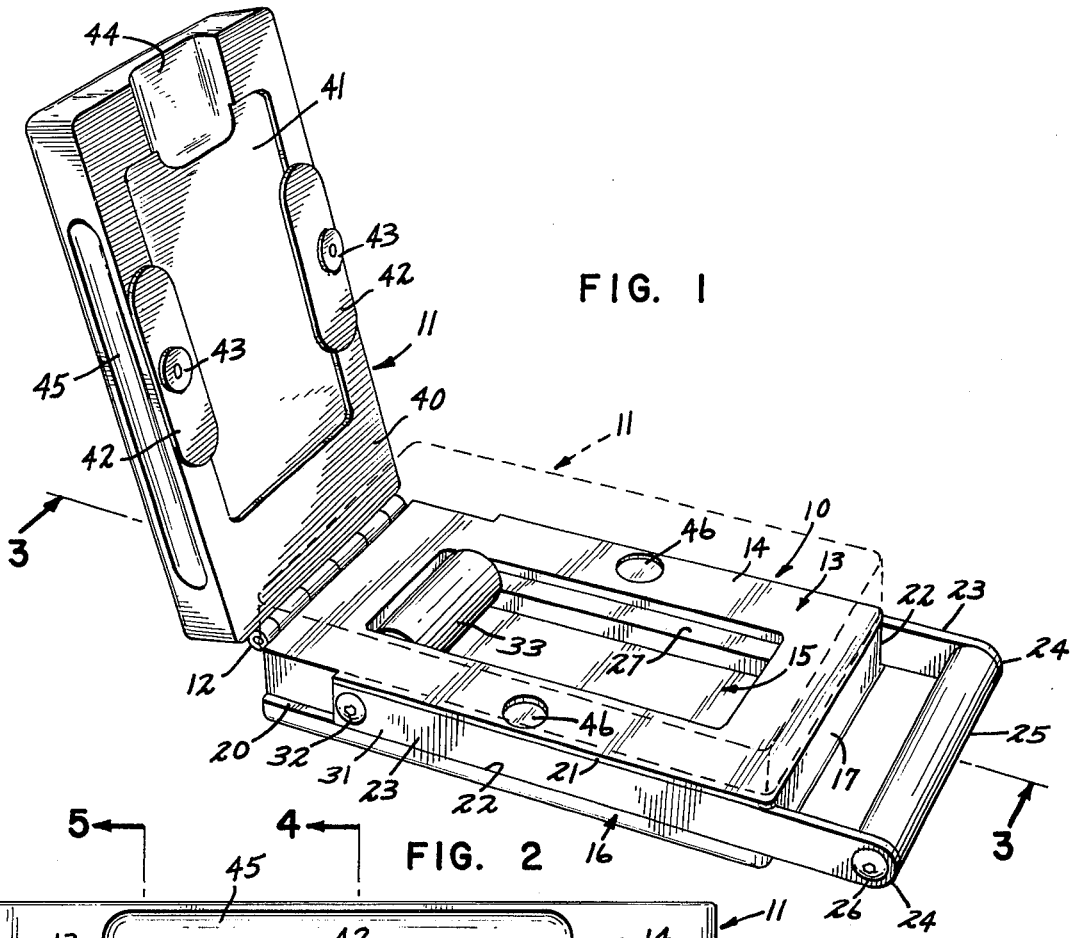
FIG. 1
FIG. 2
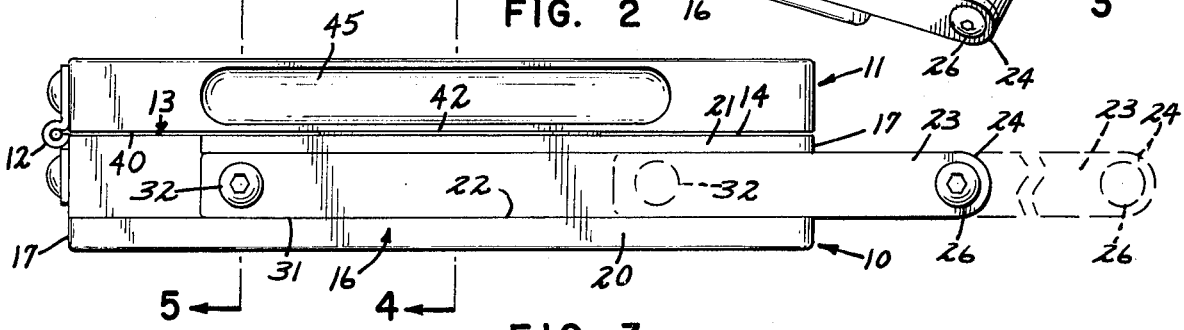
FIG. 3
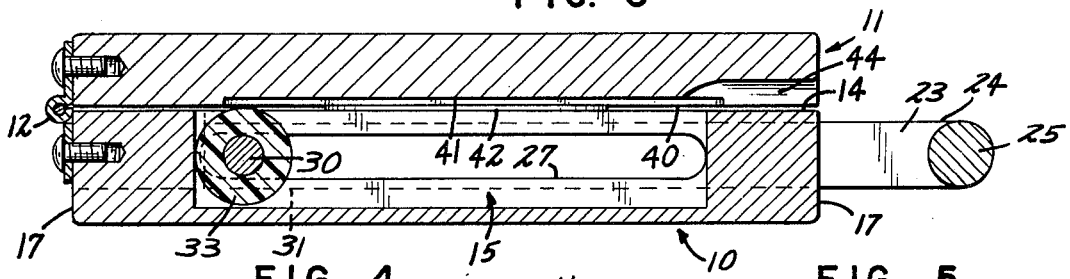
FIG. 4
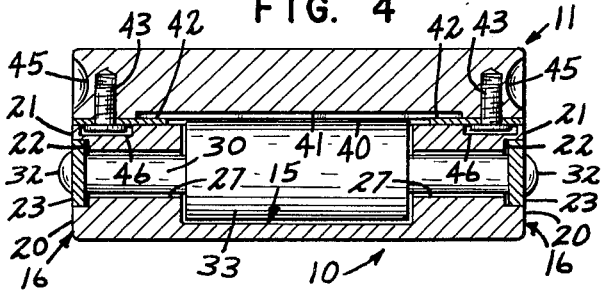
FIG. 5
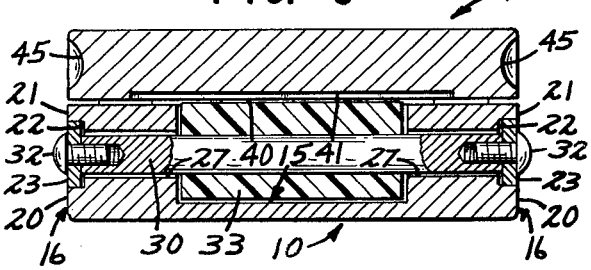

PORTABLE IMPRINTER

BACKGROUND OF THE INVENTION

This invention pertains to the general field of printing, and particularly to means for imprinting on a document the data contained in the form of raised characters on a device such as a credit card.

In general, it is well known to record data in the form of raised letters on a metallic or plastic blank, and then use the blank as a printing member, in combination, for example, with an inked ribbon, to transfer the data to new locations such as envelopes, letterheads, or department store or filling station sales slips. Apparatus for such applications is generally used indoors, out of the weather, in relatively fixed locations, so that portability, ruggedness, low cost, and simplicity of construction are not controlling design factors.

Considering for the moment the application of imprinters in filing stations, it is at present necessary for the attendant, after he has performed the services desired by the customer, to take the customer's credit card with him into the station, imprint a sales slip, and pertinent details of the transaction, return to the customer with the imprinted form, return the customer's credit card to him, wait while the customer signs the sales slip, give the customer his signed copy, and return the original to the station for safekeeping. Sometimes, in fair weather, some of this walking can be obviated by installing an imprinter on an "island" at the station. However, there frequently occur "bottlenecks" where several employees of the station must wait their turn to use the imprinter.

My invention comtemplates an imprinter so light, simple, durable, and inexpensive as to justify the provision of one such unit for each employee of a store, filling station, etc., to be carried with him if need be, ready for use at any time or place. With the advent of driver's licenses with raised letters, a unit could be made a part of the equipment of every police car, facilitating and shortening the preparation of traffic tickets and similar instruments. Other applications of an inexpensive portable imprinter will doubtless occur to the reader out of his own experience.

SUMMARY OF THE INVENTION

My invention comprises a portable imprinter in which the pressure member of platen is a roller mounted on a shaft fixed rigidly to arms which are themselves slidable between guide members in the form of grooves formed in opposite walls of a housing having a top surface with an opening through which the pressure member may project slightly from below. The document to be imprinted is placed on the top surface and a hinged member containing the imprinting card or other element is pivoted into contact with the document. A straight pull on a handle connected to the ends of the arm remote from the pressure member is all that is needed to cause the imprinting of the recorded data, using conventional forms of carbon paper or similar transfer inserts.

By my structure, the intensity of imprinting may be somewhat regulated by the pressure manually exerted on the imprinting card. The structure is simplified in the extreme, no cradle, carrier, or other accessory to the platen itself being necessary, and the number of moving parts being reduced to one, or two if the hinged member is included. The simplicity of construction and operation make my arrangement very inexpensive and convenient, and proper selection of materials can make its weight as small as is its actual size, compared to prior commercially available structures.

Various advantages and features of novelty which characterize my invention are pointed out with particularity in the claims annexed hereto and forming a part hereof. However, for a better understanding of the invention, its advantages, and objects attained by its use, reference should be had to the drawing which forms a further part hereof, and to the accompanying descriptive matter, in which there is illustrated and described a preferred embodiment of the invention.

BRIEF DESCRIPTION OF THE DRAWING

In the drawing,

FIG. 1 is a perspective view of an imprinter according to my invention;

FIG. 2 is a view of the invention in side elevation; and FIGS. 3, 4 and 5 are sectional views taken along the line 3—3 of FIG. 1 and the lines 4—4 and 5—5 of FIG. 2; respectively.

DESCRIPTION OF THE PREFERRED EMBODIMENT

As shown in FIG. 1, an imprinter according to my invention comprises a frame member 10 and a carrier member 11 connected by a hinge 12 for pivoting between an open position, shown in solid lines, and a closed position, suggested by the broken lines.

Frame member 10 comprises a housing having a top 13 with a flat upper surface 14 surrounding a rectangular opening 15. Depending from top 13 is a wall made up of a pair of sides 16, 16 and a pair of ends 17, 17. Each side is provided with guide members 20, 21 which cooperate to define a guideway or track 22. Arms 23 are arranged to slide with respect to frame member 10 in the guideways and, are connected at first, outer ends 24 by a first cross member or handle 25, to which the arms are connected by suitable means such as large allen head screws 26.

Sides 16 are apertured, in the areas between the guide member, by slots 27 of considerable width. A second cross member or shaft 30, of diameter less than the width of slots 27, extends across the frame below top 13, between the ends 31 of arms 23 remote from handle 25, and is rigidly connected thereto by fasteners 32 which may be like screws 26.

A pressure member or platen roller 33 is mounted on shaft 30 within frame member 10 so that its periphery projects slightly above surface 14. I prefer that this periphery projects slightly above surface 14. I prefer that this periphery be slightly resilient, and the roller may be free to rotate on shaft 30 if desired. The lengths of shaft 30 and handle 25 are such, compared to the dimensions of frame member 10 between the bottoms of guideways 22, as to hold arms 23 in smooth sliding relation between the guide members. I particularly desire that there be no contact between frame member 10 and shaft 30, so that all the force acting on roller 33 in a direction normal to surface 14 is conveyed by shaft 30 and arms 23 to guide members 20, 21.

Turning now to carrier member 11, one surface 40 thereof has a central slight recess 41 configured to receive a credit card: a pair of thin resilient holders 42 are secured to surface 40 by appropriate fasteners 43 to retain such a card in position when inserted in recess 41, and the end of carrier member 11 remote from hinge 12 has a recess 44 to facilitate insertion and removal of the card. Edges of carrier member 11 may have grooves 45 to facilitate opening the imprinter for insertion or removal of work pieces. If desired, top 14 of frame member 10 may be recessed as at 46 to accept fasteners 43, but if so, the recesses should be enough larger than the fasteners to avoid a punching effect on documents being imprinted.

In use, a credit card (not shown) is inserted in recess 41 of carrier member 11 under holders 42, with the raised letters directed outwardly, that is toward frame member 10. Ordinarily, roller 33 will be in the position shown in FIG. 1, that is, in its position nearest hinge 12. The document to be imprinted is now positioned on surface 14, with opening 15 located where the imprint is to be made, and the imprinter is closed. It is understood that the imprinter is designed for use with forms having carbon paper or other transfer material appropriately positioned over the area to be imprinted.

Now a simple pull on handle 25, to the right in FIGS. 1–3, causes roller 33 to move across opening 15, firmly pressing the document against the card, to transfer markings to the document at locations and in patterns determined by the raised characters on the card. During this movement, the device is held closed, member 10 toward member 11, by the hand of the user not grasping handle 25. If desired, that handle may be pushed back to its original position before the device is opened, reinforcing the imprint. After the device is opened, the imprinted document is immediately available for inspection, signature, or addition of special notes, and the credit card may be easily removed for return to the holder.

Numerous characteristics and advantages of my invention have been set forth in the foregoing description, together with details of the structure and function of the invention, and the novel features thereof are pointed out in the appended claims. The disclosure, however, is illustrative only, and changes may be made in detail, especially in matters of shape, size and arrangement of parts, within the principle of the invention, to the full extent indicated by the broad general meaning of the terms in which the appended claims are expressed.

What is claimed is:

1. A portable imprinter adapted for hand-held operation and including a frame member and a carrier member hinged together for relative pivotal movement between an open position, and a closed position maintained by manual force of the operator, said carrier member comprising means for securing a flat object having raised characters in a predetermined position and supporting said object against pressure applied against said characters;

and said frame member including a. a rigid housing comprising a flat surface surrounding an opening, and a wall depending therefrom including a pair of ends and a pair of parallel sides having guideway grooves extending parallel to said surface, said opening being so located that in said closed position it is in apposition with an object secured to said carrier member b. a rigid actuator comprising a pair of elongated arms in sliding engagement longitudinally with said grooves, a first cross member extending between and secured to said arms at locations near first ends thereof, and a second cross member extending between said arms, at locations thereon remote from said first ends thereof, to lie parallel to and displaced from said surface, the lengths of said cross members being such as to retain said arms in engagement with said grooves, said wall being provided with apertures traversed by portions of said actuator so that as said actuator is moved in said grooves said first cross member remains outside the housing and said second cross member remains within said housing, and c. a pressure member carried by said second cross member to project into said opening, for movement with said actuator across said opening, the pressure exerted by said pressure member against a flat object on said carrier member being determined by the force applied to hold said frame and carrier members in said closed position.

2. A portable imprinter for hand-held operation comprising, in combination:

a frame member including a rigid housing having a flat upper surface surrounding a generally rectangular opening and a wall depending form the perimeter thereof including a pair of ends and a pair of parallel sides including guideway grooves extending parallel to said surface at a predetermined distance therefrom;

a rigid actuator including a pair of arms slidably received in said grooves and including a first cross member in the form of a handle extending between and secured to said arm at locations near first end thereof, and a second cross member extending between and secured to said arms at locations near second ends thereof, the lengths of said cross members being such as to retain said arms in engagement with said grooves, said sides being further provided with slots extending along and communicating with said grooves for traversal by said second cross member as said actuator is displaced linearly in said grooves, said slots being sized to prevent engagement thereof by said second cross member during displacement of said actuator;

a resilient pressure member rotatably mounted on said second cross member and projecting into said opening for movement across said opening controlled entirely by movement of said actuator;

a carrier member hinged at one end to an end of said housing and having a second flat surface which pivots about the hinge into substantial coincidence with the flat surface of said housing to define a closed condition of said imprinter, which can be maintained by one hand of a user while the other hand causes said displacement of said actuator;

a recess in said second surface sized to receive a printing member such as a credit card having raised characters extending away from said second surface, and positioned to come into apposition with said opening in said closed condition of said imprinter; and means for retaining such a printing member in said recess so that the bottom of said recess supports said printing member against force exerted thereon by said pressure member in said closed condition of said imprinter.

* * * * *

UNITED STATES PATENT AND TRADEMARK OFFICE

CERTIFICATE OF CORRECTION

PATENT NO. : 4,027,589

DATED : June 7, 1977

INVENTOR(S) : David G. Timm

It is certified that error appears in the above-identified patent and that said Letters Patent are hereby corrected as shown below:

Please change the heading from "Abstract" to --Abstract of the Disclosure--.

Column 1, line 20, "filing" should be --filling--.

Column 1, line 23, "and" should be --add--.

Column 1, line 48, "of" should be --or--.

Column 2, line 43, "member" should be --members--.

Column 2, lines 51 and 52 please delete the sentence beginning with "I prefer that . . . above surface 14". This sentence was not in applicant's specification.

Column 3, line 11, "that is" should be --that is,--.

Column 4, line 31, "end" should be --ends--.

Signed and Sealed this

*Eleventh* Day of *October 1977*

[SEAL]

*Attest:*

RUTH C. MASON
*Attesting Officer*

LUTRELLE F. PARKER
*Acting Commissioner of Patents and Trademarks*